US011459220B2

(12) United States Patent
Sutar et al.

(10) Patent No.: US 11,459,220 B2
(45) Date of Patent: Oct. 4, 2022

(54) HYDRAULIC SYSTEM WITH LOAD SENSE AND METHODS THEREOF

(71) Applicant: Danfoss Power Solutions II Technology A/S, Nordborg (DK)

(72) Inventors: Nilesh Anant Sutar, Pune (IN); Muzammil Qayyumoddin Quazi, Pune (IN)

(73) Assignee: Danfoss Power Solution II Technology A/S, Nordborg (DK)

( * ) Notice: Subject to any disclaimer, the term of this patent is extended or adjusted under 35 U.S.C. 154(b) by 7 days.

(21) Appl. No.: 16/202,228

(22) Filed: Nov. 28, 2018

(65) Prior Publication Data

US 2019/0161328 A1 May 30, 2019

(30) Foreign Application Priority Data

Nov. 30, 2017 (IN) ..... 201711042973

(51) Int. Cl.
*F15B 11/16* (2006.01)
*B66F 7/08* (2006.01)
(Continued)

(52) U.S. Cl.
CPC ..... *B66F 7/08* (2013.01); *B66F 11/046* (2013.01); *F15B 11/165* (2013.01);
(Continued)

(58) Field of Classification Search
CPC ..... F15B 2211/25; F15B 2211/251; F15B 2211/252; F15B 2211/253;
(Continued)

(56) References Cited

U.S. PATENT DOCUMENTS 2,590,137 A * 3/1952 Towler ..... B30B 15/186 91/451
3,506,031 A * 4/1970 Stacey ..... F15B 13/02 137/596

(Continued)

FOREIGN PATENT DOCUMENTS

CN 103671323 A 3/2014
CN 104863911 B 8/2015

(Continued)

OTHER PUBLICATIONS

Load Sensing Systems Principle of Operation, Eaton Corporation, Nov. 1992, 28 pages.

(Continued)

*Primary Examiner* — Craig J Price
(74) *Attorney, Agent, or Firm* — Merchant & Gould P.C.

(57) ABSTRACT

A hydraulic system includes a pump in communication with a fluid reservoir and powered by a motor. A pressure compensator is adapted to adjust a position of a variable displacement mechanism of the pump. A load sensing line is adapted to communicate a highest load sensing pressure from a plurality of valves to the pressure compensator. The pressure compensator adjusts the variable displacement mechanism of the pump based on the highest load sensing pressure for maintaining a constant pressure drop across one or more work ports in each of the plurality of valves. The plurality of valves each include a load sense port having an integrated check valve that includes a metering orifice.

15 Claims, 9 Drawing Sheets

(51) Int. Cl.
*F15B 13/04* (2006.01)
*B66F 11/04* (2006.01)

(52) U.S. Cl.
CPC ..... *F15B 13/0405* (2013.01); *F15B 13/0417* (2013.01); *F15B 2211/20546* (2013.01); *F15B 2211/253* (2013.01); *F15B 2211/605* (2013.01); *F15B 2211/6313* (2013.01); *F15B 2211/6652* (2013.01); *F15B 2211/7054* (2013.01); *F15B 2211/71* (2013.01); *Y10T 137/0396* (2015.04); *Y10T 137/86702* (2015.04)

(58) Field of Classification Search
CPC ..... F15B 2211/6052; F15B 2211/6055; F15B 2211/71; F15B 2211/7107; F15B 2211/7114; F15B 2211/7121; F15B 2211/7128; F15B 2211/7135; F15B 2211/7142; F15B 2211/70; F15B 2211/705; F15B 2211/7051; F15B 2211/7052; F15B 2211/7053; F15B 2211/7054; F15B 2211/7055; F15B 2211/7056; F15B 2211/7057; F15B 2211/7058; F15B 2211/00; F15B 2211/20; F15B 2211/205–20592; F15B 2211/665; F15B 2211/6651–6658; F15B 2211/65; F15B 2211/651–654; F15B 2211/60; F15B 2211/6051–6058; F15B 13/04–0407; F15B 13/0416; F15B 13/0417; F15B 13/0418; F15B 11/16–22; F15B 2211/6313; F15B 11/165; F15B 2211/605; B66F 7/08; B66F 7/085; B66F 11/044; B66F 11/046; Y10T 137/86734; Y10T 137/86775; Y10T 137/86807; Y10T 137/86702; Y10T 137/0396
USPC ..... 137/625.3, 625.35, 625.38, 625.68
See application file for complete search history.

(56) References Cited

U.S. PATENT DOCUMENTS 4,525,695 A * 6/1985 Sheng ..... H01F 7/1615 137/625.65
4,723,475 A 2/1988 Burk
4,725,039 A * 2/1988 Kolchinsky ..... F16K 3/26 137/454.2
5,060,475 A 10/1991 Latimer
5,117,869 A * 6/1992 Kolchinsky ..... F16K 31/0613 137/625.65
5,249,603 A * 10/1993 Byers, Jr. ..... H01F 7/1615 137/625.65
5,299,060 A * 3/1994 Mori ..... B60R 1/0602 359/507
5,715,674 A * 2/1998 Reuter ..... F02C 9/30 60/39.281
5,813,310 A * 9/1998 Hori ..... E02F 9/2271 137/596.2
5,878,782 A * 3/1999 Nakajima ..... F16K 31/0613 137/625.65
6,216,456 B1 4/2001 Michell
6,311,674 B1 * 11/2001 Igashira ..... F02D 41/3845 123/458
6,554,014 B2 4/2003 Beyrak
6,684,835 B2 * 2/2004 Komazawa ..... F01L 1/3442 123/90.17
6,745,992 B2 * 6/2004 Yang ..... F15B 13/0405 251/129.15
6,789,570 B2 9/2004 Beyrak et al.
6,966,329 B2 11/2005 Liberfarb
7,063,100 B2 6/2006 Liberfarb
7,069,945 B2 7/2006 Slawinsky et al.
7,137,406 B2 11/2006 Slawinsky et al.
7,261,030 B2 8/2007 Liberfarb et al.
7,533,695 B2 * 5/2009 Strauss ..... F01L 1/022 123/90.17
7,921,880 B2 * 4/2011 Jackson ..... F15B 11/042 137/881
8,104,511 B2 * 1/2012 Reilly ..... F16K 31/0613 137/625.65
8,191,579 B2 * 6/2012 Imhof ..... G05D 7/005 137/625.38
8,253,063 B2 8/2012 Alexander et al.
8,297,244 B2 * 10/2012 Hoppe ..... F01L 1/3442 123/90.17
8,434,516 B2 * 5/2013 Aranovich ..... F15B 13/044 137/625.67
8,757,208 B2 * 6/2014 Dornbach ..... G05D 16/166 137/625.61
8,839,820 B2 * 9/2014 Hoppe ..... F01L 1/34 137/625.68
9,027,589 B2 5/2015 Coolidge
9,027,598 B2 * 5/2015 Schneider ..... F16K 31/0613 137/625.68
9,157,544 B2 * 10/2015 Shimizu ..... F16H 61/0021
9,200,645 B2 12/2015 Krahn
9,323,253 B2 4/2016 Dybing
9,366,161 B2 * 6/2016 Morehead ..... F01L 1/3442
9,523,438 B2 * 12/2016 Bamber ..... F16K 11/04
9,708,796 B2 7/2017 Johnson
9,784,143 B2 * 10/2017 Snyder ..... F01L 1/3442
9,903,235 B2 * 2/2018 Mukaide ..... F01L 1/344
9,964,965 B2 * 5/2018 Dornbach ..... F16K 27/048
10,508,964 B2 * 12/2019 Ambrose ..... F16K 15/1823
10,641,298 B2 * 5/2020 Schmidt ..... F16K 11/0716
10,781,804 B2 * 9/2020 Higashidozono ..... F04B 27/18
11,009,048 B1 * 5/2021 Neumann ..... E02F 9/2221
2003/0000373 A1 * 1/2003 Weber ..... F15B 13/021 91/446
2004/0089830 A1 5/2004 Beyrak
2004/0226292 A1 * 11/2004 Luo ..... E02F 9/2207 60/468
2006/0254268 A1 * 11/2006 Yasuda ..... F16H 61/40 60/435
2007/0056632 A1 * 3/2007 Cheong ..... F16K 17/105 137/491
2007/0246112 A1 * 10/2007 Aranovich ..... F15B 13/0835 137/625.65
2008/0245983 A1 * 10/2008 Hoppe ..... H01F 7/1607 251/65
2009/0050222 A1 2/2009 Jackson et al.
2009/0230337 A1 * 9/2009 Hoppe ..... F16K 31/0613 251/62
2010/0163128 A1 * 7/2010 Kinscher ..... F16K 27/048 137/625.64
2014/0251470 A1 9/2014 Bissbort et al.
2014/0299197 A1 10/2014 Dornbach et al.
2014/0366520 A1 12/2014 Krahn
2015/0059671 A1 * 3/2015 Mukaide ..... F01L 1/3442 123/90.15
2017/0191506 A1 7/2017 Lacher et al.
2017/0241555 A1 8/2017 Mizukami

FOREIGN PATENT DOCUMENTS

CN 105221506 B 1/2016
EP 987444 A3 3/2000
EP 1054152 A3 11/2000
EP 1231387 A3 8/2002
EP 1197692 B1 3/2004
EP 1420321 A3 9/2004

(56) References Cited

FOREIGN PATENT DOCUMENTS

| | | | |
|---|---|---|---|
| JP | 04969347 | B2 | 7/2012 |
| JP | 2017089865 | A | 5/2017 |

OTHER PUBLICATIONS

GB Search Report corresponding to GB1819466.2, dated May 20, 2019.
"Proportional Solenoid Valve 3 Position, 5 Port, Closed Center Spool," SP10-57C, hydraforce.com, accessed Oct. 26, 2017, 4 pages.
"Proportional Solenoid Valve 3 Position, 5 Port, Closed Center Spool," SP08-57D, hydraforce.com, accessed Oct. 26, 2017, 4 pages.
"5/3 directional spool valve, directoperated, with solenoid actuation, Type VEDS.53," Rexroth Bosch Group, RE 18158 Edition: Nov. 2021, accessed Oct. 26, 2017, 12 pages.
"1CE20—Overcenter valve," Eaton Hydraulic Screw-in Cartridge Valves (SiCV), E-VLS-MC001-E6, Jan. 2018, www.eaton.com, 4 pages.
"DPC2-8—Check Valve," G-330.A, Eaton Screw-in Cartridge Valves, E-VLS-MC001-E6, Dec. 2009, 2 pages.
Search Report from co-pending UK Application No. GB1819466.2, 4 pages (dated Feb. 10, 2022).

* cited by examiner

HYDRAULIC SYSTEM WITH LOAD SENSE AND METHODS THEREOF

CROSS-REFERENCE TO RELATED APPLICATIONS

This application claims priority to Indian Provisional Patent Application Number 201711042973 filed Nov. 30, 2017, the disclosure of which is incorporated herein by reference in its entirety.

BACKGROUND

Fluid systems used in various applications often have requirements that are variable. For example, fluid systems may require variable flow rates and variable fluid pressures. Load sensing pumps can be used to tailor the operation of a pump to meet the variable flow requirements of a given fluid system. A typical load sense pump uses flow and pressure feedbacks in the fluid system to adjust the flow requirements of the pump. The variable nature of fluid systems also places a variable demand on the source used to power the pump. Improvements in pump control and power source management are desired.

SUMMARY

Aspects of the present disclosure relate to improving the architecture of a hydraulic valve having an integrated load sensing functionality to decrease power consumption of the hydraulic valve while also decreasing the size of the valve.

In one aspect, the disclosed technology relates to a proportional load sensing hydraulic valve comprising a housing having a bore and a major axis that extends through a center of the bore; a spool inside the bore of the housing and being coaxial with the major axis; a pump port, first and second work ports, a tank port, and a load sensing port, the load sensing port being coaxial with the major axis and the spool; and a check valve inside the load sensing port. The check valve has a metering orifice biased in a closed position by a check valve spring. The metering orifice is adapted to balance a load sense pressure at the pump port with a pressure at the first and second work ports. The metering orifice moves from the closed position to a metered position when a minimum cracking pressure is reached inside the valve.

The spool is adapted to move along the major axis between a rested position, a first activated position, and a second activated position; wherein fluid communication is blocked between the pump port and the first and second work ports when the spool is in the rested position; wherein the pump port is in fluid communication with the first work port, and the tank port is in fluid communication with the second work port when the spool is in the first activated position; wherein the pump port is in fluid communication with the second work port, and the tank port is in fluid communication with the first work port when the spool is in the second activated position; and wherein the load sensing port is in fluid communication with the first and second work ports and the pump port when the spool is in the first activated position or the second activated position. The load sensing port is adapted to communicate the load sense pressure to a pressure compensator when the spool is in the first activated position or the second activated position.

The spool includes sealing lands for sealing a plurality of galleries between the spool and the bore; a hollow central channel extending along a length of the spool, and first and second cross holes connecting the central channel to the plurality of galleries. The spool may further include a jet inside the central channel that communicates pressure between right and left sides of the spool, the jet having a length that extends beyond the second cross hole of the spool by a distance that is approximately 2-3 times the diameter of the second cross hole. The load sensing port is coaxial with the jet. In some examples, the spool is a closed center spool. In other examples, the spool is an open center spool. The valve can be mounted inside a manifold block.

In another aspect, the disclosed technology relates to a hydraulic system comprising: a pump in communication with a fluid reservoir and powered by a motor, the pump having a variable displacement mechanism; a pressure compensator adapted to adjust the position of the variable displacement mechanism of the pump based on a load sense pressure; and a load sense line adapted to communicate a highest load sense pressure from a plurality of valves to the pressure compensator. Each of the plurality of valves includes a spool positioned inside a bore of a housing, the housing defines a pump port, first and second work ports, a tank port, and a load sensing port. The load sensing port includes a check valve having a metering orifice biased in a closed position by a check valve spring. The check valve is adapted to move from the closed position to a metered position when a minimum cracking pressure is reached. The metering orifice is adapted to balance a load sense pressure at the pump port with a pressure at the first and second work ports. The pressure compensator adjusts the variable displacement mechanism of the pump based on the highest load sensing pressure for maintaining a constant pressure drop across the first and second work ports in each valve.

The spool in each of the plurality of valves includes sealing lands for sealing a plurality of galleries between the spool and the bore; a hollow central channel extending along a length of the spool; and first and second cross holes connecting the central channel to the plurality of galleries. The spool in each of the plurality of valves may further include a jet inside the central channel that communicates pressure between right and left sides of the spool, the jet having a length that extends beyond the second cross hole of the spool by a distance that is approximately 2-3 times the diameter of the second cross hole. In some examples, the spool in each of the plurality of valves is a closed center spool. In other examples, the spool in each of the plurality of valves is an open center spool.

In another aspect, the disclosed technology relates to a method of operating a hydraulic system comprising: receiving a command to actuate an actuator of a mechanical device; sending a signal to a solenoid to move a control spool of a proportional hydraulic valve from a rested position to a first activated position; commanding a pump to direct fluid to the proportional valve through a pump port for feeding fluid to a work port and a load sensing port; receiving a load sense pressure from the load sensing port; and sending the load sense pressure to a pressure compensator adapted to modulate flow output from the pump for maintaining a constant pressure differential across the work port. The load sensing port includes a check valve having a metering orifice biased in a closed position by a check valve spring, the metering orifice is adapted to move from the closed position to a metered position in response to sensing the load sense pressure. The metering orifice is adapted to balance a load sense pressure at the pump port with a pressure at the first and second work ports.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DRAWINGS

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 1:
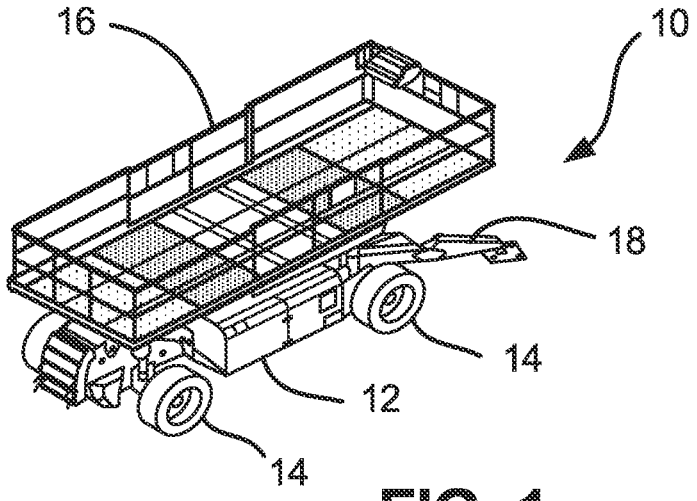
FIG. 1 (Prior Art)
FIG. 1 depicts an aerial work platform in a lowered position.
Figure 2:
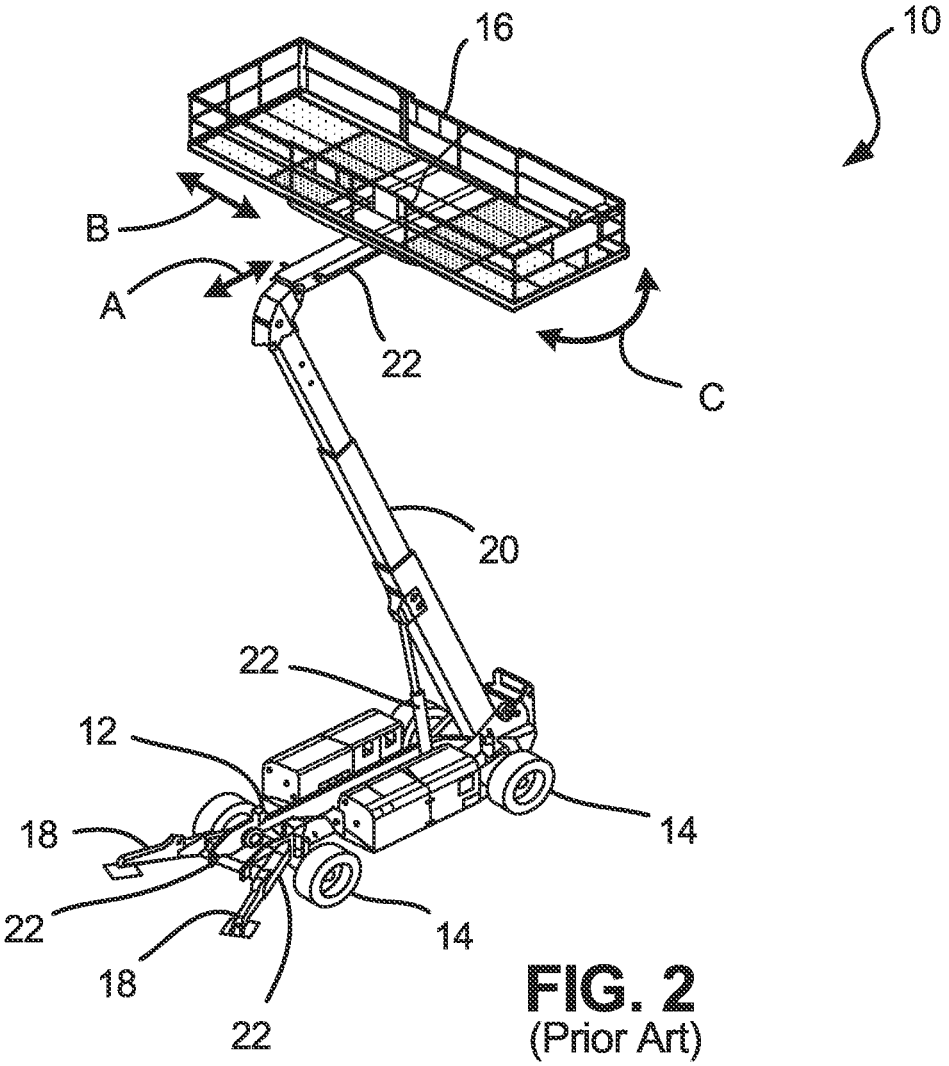
FIG. 2 (Prior Art)
FIG. 2 depicts the aerial work platform in a raised position.

FIGS. 1 and 2 depict an aerial work platform 10 in a lowered position and a raised position, respectively. The aerial work platform 10, also known as a scissor lift or elevating work platform, is a mechanical device that provides access to high elevation areas. The aerial work platform 10 can be used for temporary, flexible access purposes such as maintenance and construction work, or for emergency access (e.g., by firefighters).

The aerial work platform 10 includes a body 12, wheels 14 for mobility around the ground or a floor area, a platform 16 for lifting loads, and retractable stands 18 for stabilizing the aerial work platform 10 when the platform 16 is raised. The platform 16 can be used to lift personnel and/or equipment that can weight approximately one ton.

As shown in FIGS. 1 and 2, the platform 16 is raised or lowered by an arm 20 operated by an actuator 22. When in a raised position, the platform 16 may slide in forward and rearward directions (as depicted by the arrow A), may slide in leftward and rightward directions (as depicted by the arrow B), and may also rotate about the arm 20 (as depicted by the arrow C). The movement of the platform 16 when in the raised position may be controlled by one or more additional actuators 22 (see FIG. 3). Also, the deployment of the retractable stands 18 may be controlled by one or more additional actuators 22 (see FIG. 3).

Figure 3:
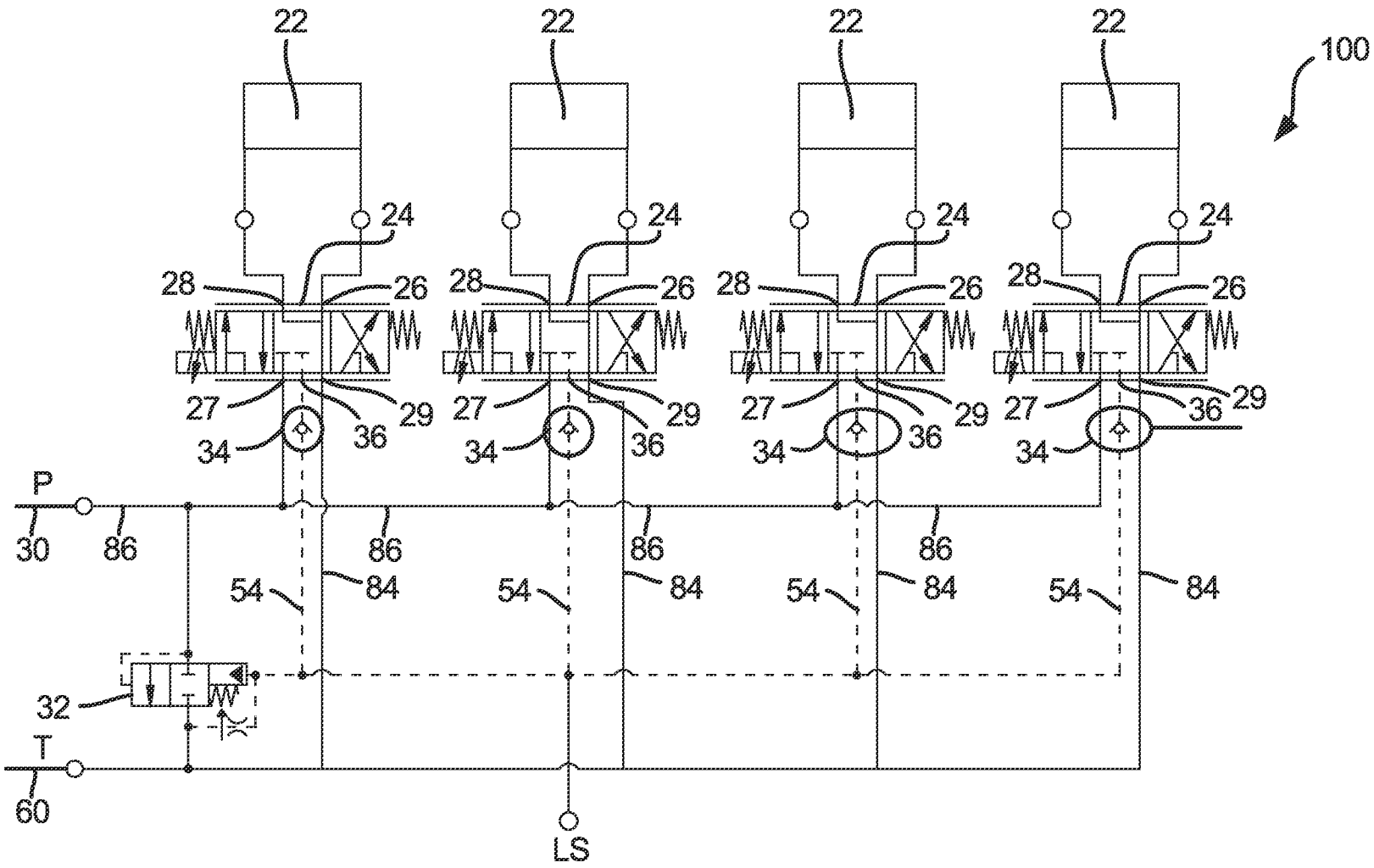
FIG. 3 (Prior Art)
FIG. 3 is a schematic representation of a hydraulic system suitable for use in the aerial work platform of FIGS. 1 and 2.

FIG. 3 is a schematic representation of a hydraulic system 100 suitable for use in the aerial work platform 10. Referring now to FIG. 3, the aerial work platform 10 utilizes the hydraulic system 100 to operate and control the movement of the various actuators 22 for raising and lowering the platform 16, rotating the platform 16, sliding the platform 16, and deploying the retractable stands 18. Each actuator 22 is connected to a valve 24 via a first work port 26 and a second work port 28. Each valve 24 receives hydraulic fluid from a pump 30 powered by a motor via a pump port 27 connected to a pump line 86 and drains hydraulic fluid to a fluid reservoir 60 via a tank port 29 connected to a tank line 84. The pump 30 is a variable displacement pump. A pressure compensator 32 is connected the pump 30 and adjusts the displacement of the pump 30 based on pump pressure.

The pressure compensator 32 maintains a constant pressure drop across the work ports 26, 28 of each valve 24 regardless of a change in load pressure. In order to do this, the pressure compensator 32 receives a load sense pressure. When a single pressure compensator 32 is used in the hydraulic system 100 having multiple valves 24 for operating multiple actuators 22 in a device such as the aerial work platform 10, only the highest load sense pressure from the multiple valves 24 is communicated to the pressure compensator 32.

To do this, external load sense check valves 34 are added to a load sense line 54 proximate to each valve 24. The external load sense check valve 34 that receives the highest load sense pressure is adapted to close the remaining check valves 34 so that only the highest load sense pressure is sensed by the pressure compensator 32. Each check valve 34 on the load sense line 54 is a non-return type valve that prevents the reverse flow of the load sense pressure. Each load sense check valve 34 is connected to each valve 24 via a load sensing port 36 and is located outside each valve 24.

Figure 4:
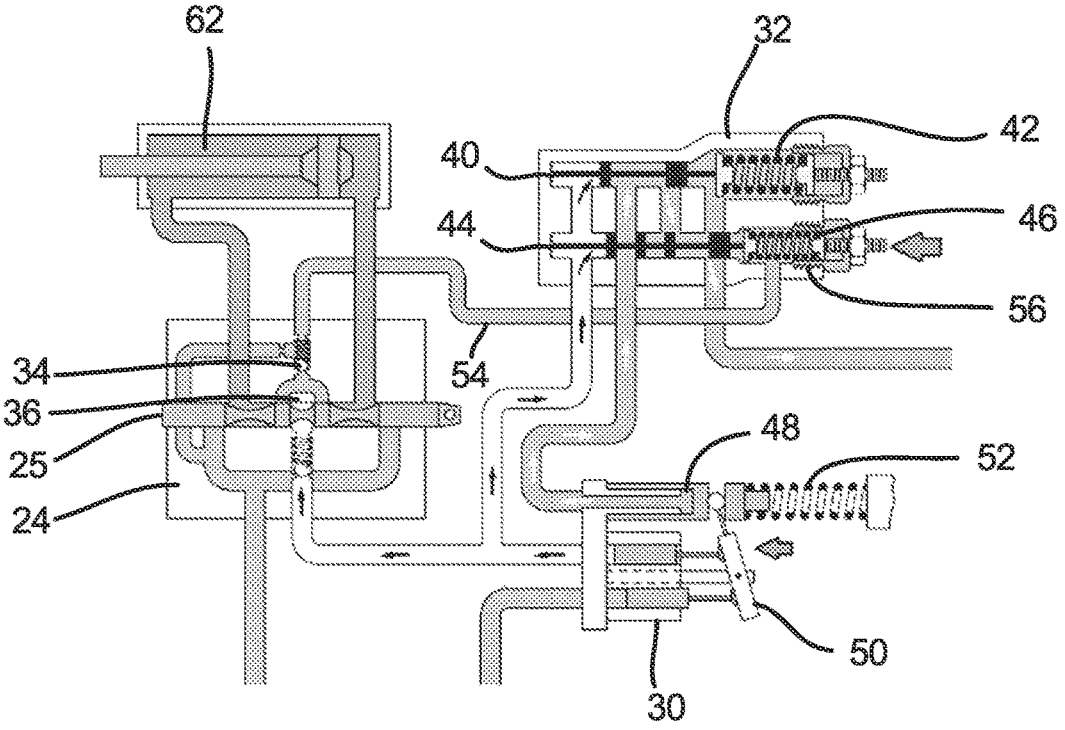
FIG. 4 (Prior Art)
FIG. 4 is a schematic representation of a pressure compensator having a load sensing functionality during an idling phase.

FIG. 4 is a schematic representation of the pressure compensator 32 having a load sensing functionality during an idling phase. As shown in FIG. 4, the pressure compensator 32 includes a high pressure compensator spool 40 that works against a high pressure spring 42 (e.g., having a biasing force of 3000 PSI), and a pressure-flow compensator spool 44 that works against a low pressure spring 46 housed in a spring chamber 56. The pressure compensator 32 is mounted directly to the pump 30. Because there is no pressure acting against a control piston 48 of a camplate 50 (which is biased by a spring 52 such that the camplate is biased in a maximum displacement position), the camplate 50 is in a maximum displacement angle and in this position the pump 30 is ready to produce maximum flow. The valve 24 is depicted as a closed center type valve such that when in a rested position, pump flow is blocked from entering the valve 24. When the motor is started, the pump flow also enters the pressure compensator 32 and acts against the left end of the pressure-flow compensator spool 44 and against the left end of the high pressure compensator spool 40.

Figure 5:
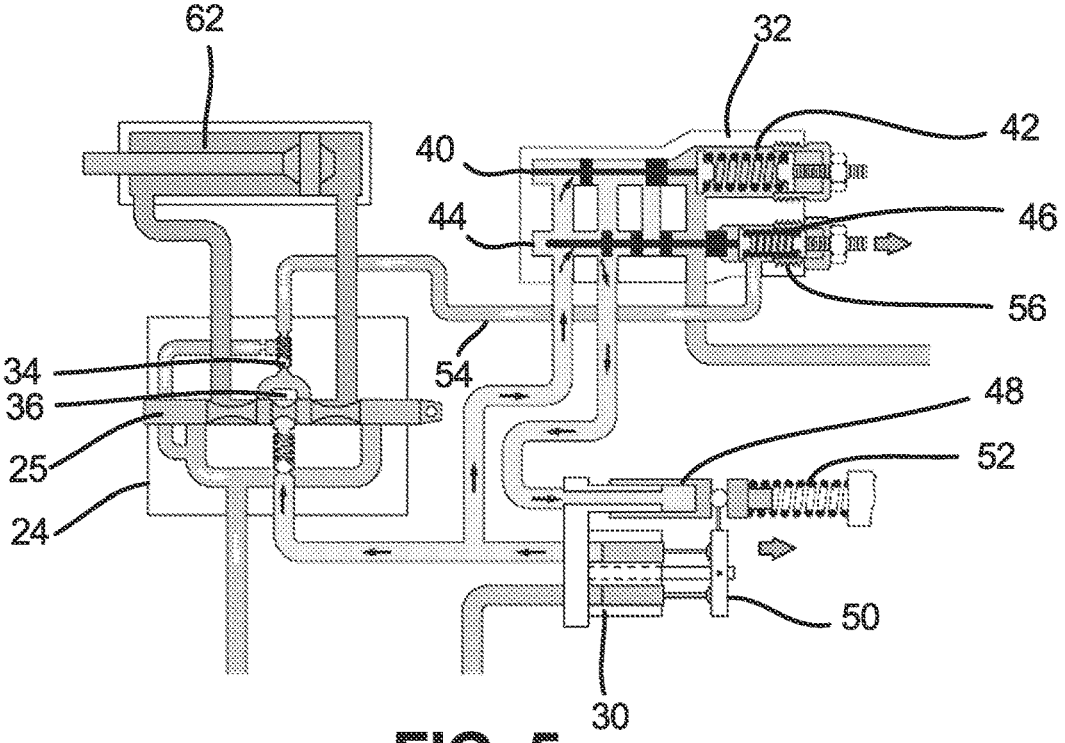
FIG. 5 (Prior Art)
FIG. 5 is a schematic representation of a pressure compensator having a load sensing functionality during a low pressure standby phase.

FIG. 5 is a schematic representation of the pressure compensator 32 during a low pressure standby phase. As shown in FIG. 5, when the pressure acting against the pressure-flow compensator spool 44 reaches a predetermined amount (e.g., 200 PSI), the spool 44 moves to the right against the biasing force of the low pressure spring 46 and opens a passage so that pump pressure is channeled to the control piston 48. The control piston 48 then moves against its spring 52 and causes the camplate 50 to stroke back toward a near zero displacement position. This position is called a low pressure standby position.

Figure 6:
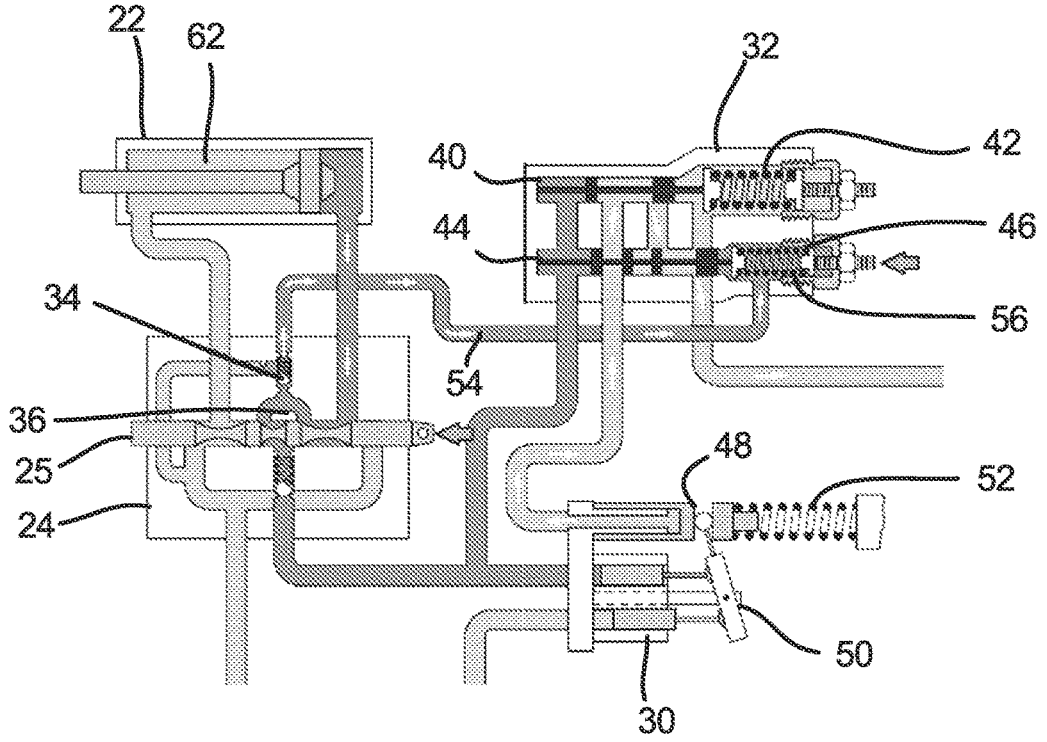
FIG. 6 (Prior Art)
FIG. 6 is a schematic representation of a pressure compensator having a load sensing functionality during an activated phase.

FIG. 6 is a schematic representation of the pressure compensator 32 during an activated phase. As shown in FIG. 6, when the control spool 25 of the valve 24 is moved to the left, a load sense pressure flows through the load sensing port 36 and past the check valve 34. The load sense pressure is then channeled via the load sense line 54 to the spring chamber 56 at the right side of the pressure-flow compensator spool 44.

The load sense pressure combines with the force of the low pressure spring 46 to move the pressure-flow compensator spool 44 to the left so that the pressure from the camplate control piston 48 is drained to tank. The camplate spring 52 forces the camplate control piston 48 to move the camplate 50 to a greater displacement angle and the pump 30 begins to produce a larger flow. As the control spool 25 of the valve 24 moves farther in the same direction, the opening of the load sensing port 36 in the control spool 25 becomes larger which creates less resistance to flow and increases the load sense pressure felt by the pressure-flow compensator spool 44. Thus, the pressure-flow compensator spool 44 moves further to the left to drain more fluid from the camplate control piston 48. This causes the pump 30 to stroke at a greater displacement angle so that the pump 30 produces a larger flow.

Figure 7:
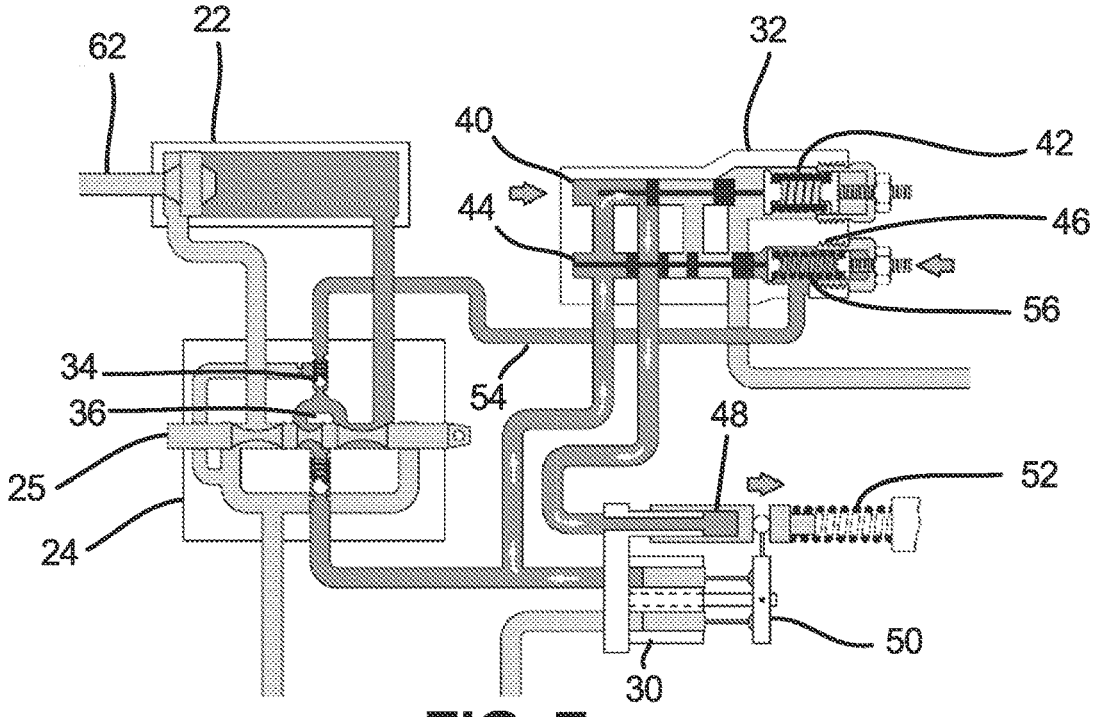
FIG. 7 (Prior Art)
FIG. 7 is a schematic representation of a pressure compensator having a load sensing functionality during a high pressure standby phase.

FIG. 7 is a schematic representation of the pressure compensator 32 during a high pressure standby phase. As shown in FIG. 7, the piston 62 of the actuator 22 will eventually reach the end of its travel and the load sense pressure from the valve 24 stops. At this point, pressure will equalize on both sides of the spool in the valve 24 and will also equalize on both ends of the pressure-flow compensator spool 44. The spring 46 forces the pressure-flow compensator spool 44 to the left. When the pressure reaches a maximum cut-off pressure (e.g., 3000 PSI), the high pressure compensator spool 40 moves to the right and directs fluid to the camplate control piston 48. The camplate control piston 48 moves the camplate 50 to the near zero displacement angle and the pump 30 stops producing flow. This position is called a high pressure standby mode.

Referring now to FIG. 3 and FIGS. 4-7, there is less resistance in the valve 24 in the flow path from the pump port 27 to the load sensing port 36 than in the flow path from the pump port 27 to the work ports 26, 28. This is at least due in part to geometries inside the valve 24 which cause a smaller pressure drop from the pump port 27 to the load sensing port 36 than from the the pump port 27 to the work ports 26, 28. Ideally, the load sense pressure should equal the work port pressure so that the displacement of the pump 30 is optimized. However, since the load sense pressure in the valve 24 is greater than the work port pressure in the valve 24, the displacement from the pump 30 is greater than it needs to be and this results in energy loss. Also, the external load sense check valve 34 attached to the housing of the load sensing valve 24 increases the size of the valve 24.

Figure 8:
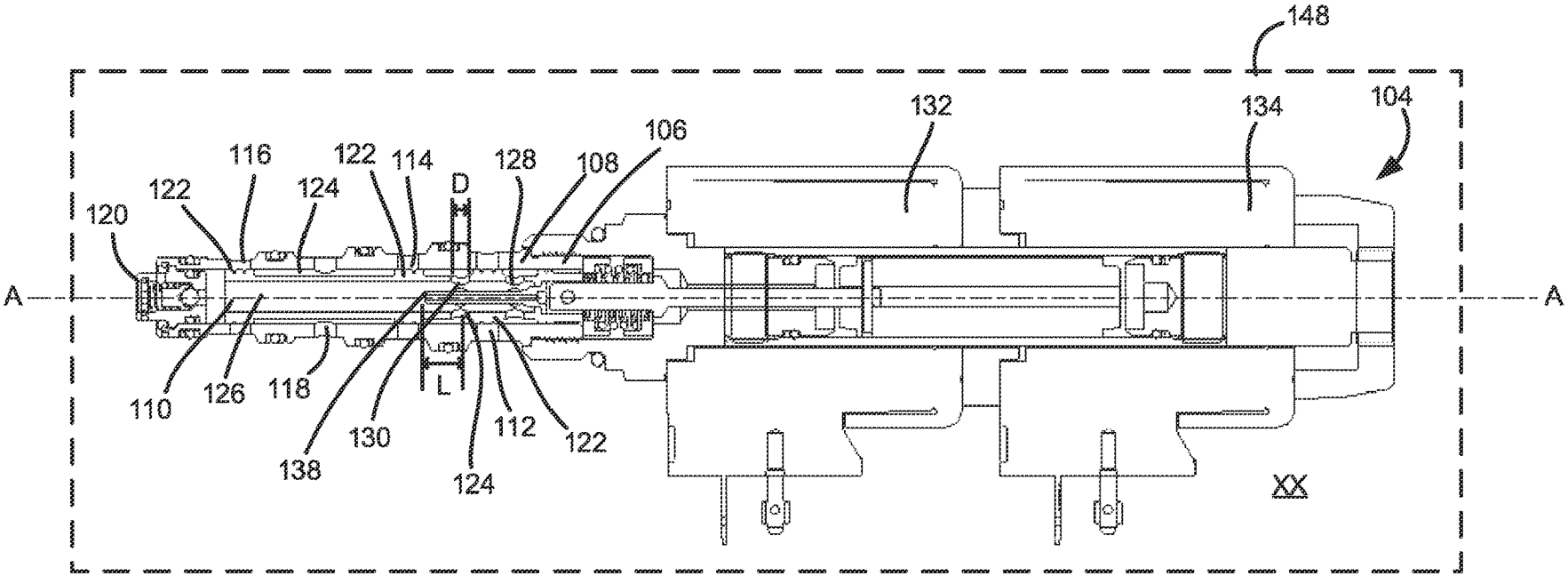
FIG. 8 is a cross-sectional view of a valve having an integrated load sensing feature.

FIG. 8 is a cross-sectional view of a valve 104 having an integrated load sensing feature a rested position XX. The valve 104 is housed inside a manifold block 148 that is mounted to a mechanical device such as, for example, the aerial work platform 10 depicted in FIGS. 1 and 2. The valve 104 includes a housing 106 that defines a hollow bore 108. The bore 108 includes a major axis A-A that extends through a center of the bore 108.

The housing 106 includes a pump port 112, a first work port 114, a second work port 116, a tank port 118, and a load sensing port 120. In some examples, the valve 104 is a 5-port proportional load sensing SiCV valve. The pump port 112 receives fluid from the hydraulic pump 30 (see FIGS. 3 and 9). The tank port 118 drains the fluid from the valve 104 to the fluid reservoir 60 (see FIGS. 3 and 9). The first and second work ports 114, 116 are connected to an actuator such as, for example, one of the actuators 22 in the hydraulic system 100 of FIG. 3 for the aerial work platform 10 of FIGS. 1 and 2. The load sensing port 120 is located at an end of the bore 108 and is coaxial with the major axis A-A.

A spool 110 is located inside the bore 108. The spool 110 is coaxial with the major axis A-A of the bore 108 and is coaxial with the load sensing port 120. The spool 110 has a number of sealing lands 122 that project radially outward. In some examples, the spool 110 is a closed center spool. In other examples, the spool 110 can be an open center spool.

The sealing lands 122 seal galleries 124 between the spool 110 and the bore 108. The galleries 124 define flow paths inside the bore 108 that connect the pump port 112, the first and second work ports 114, 116, the tank port 118, and the load sensing port 120. Each sealing land 122 has a diameter substantially equal to the diameter of the bore 108.

A hollow central channel 126 is inside the spool 110 and extends along the length of the spool 110. A first cross hole 128 and a second cross hole 130 on the body of the spool 110 are openings that connect the galleries 124 to the central channel 126.

A jet 138 is located inside the central channel 126 of the spool 110. In proportional valves, the pressure at both ends of the spool 110 should be the same in order for the valve to work under stable conditions. The jet 138 maintains stability in the valve 104 by countering flow forces inside the valve 104 by communicating pressures between the right and left sides of the spool 110. As depicted in the example of FIG. 8, the length of the jet 138 is optimized such that it extends beyond the second cross hole 130 of the spool 110 by a distance L that is approximately 2-3 times the diameter D of the second cross hole 130. The optimized length of the jet 138 improves the flow path from the pump port 112 to the first and second work ports 114, 116 while at the same time maintaining the stability in the valve 104. As further shown in FIG. 12, the jet 138 has a flange 150 that abuts an inner shoulder 152 of the spool 110.

Figure 9:
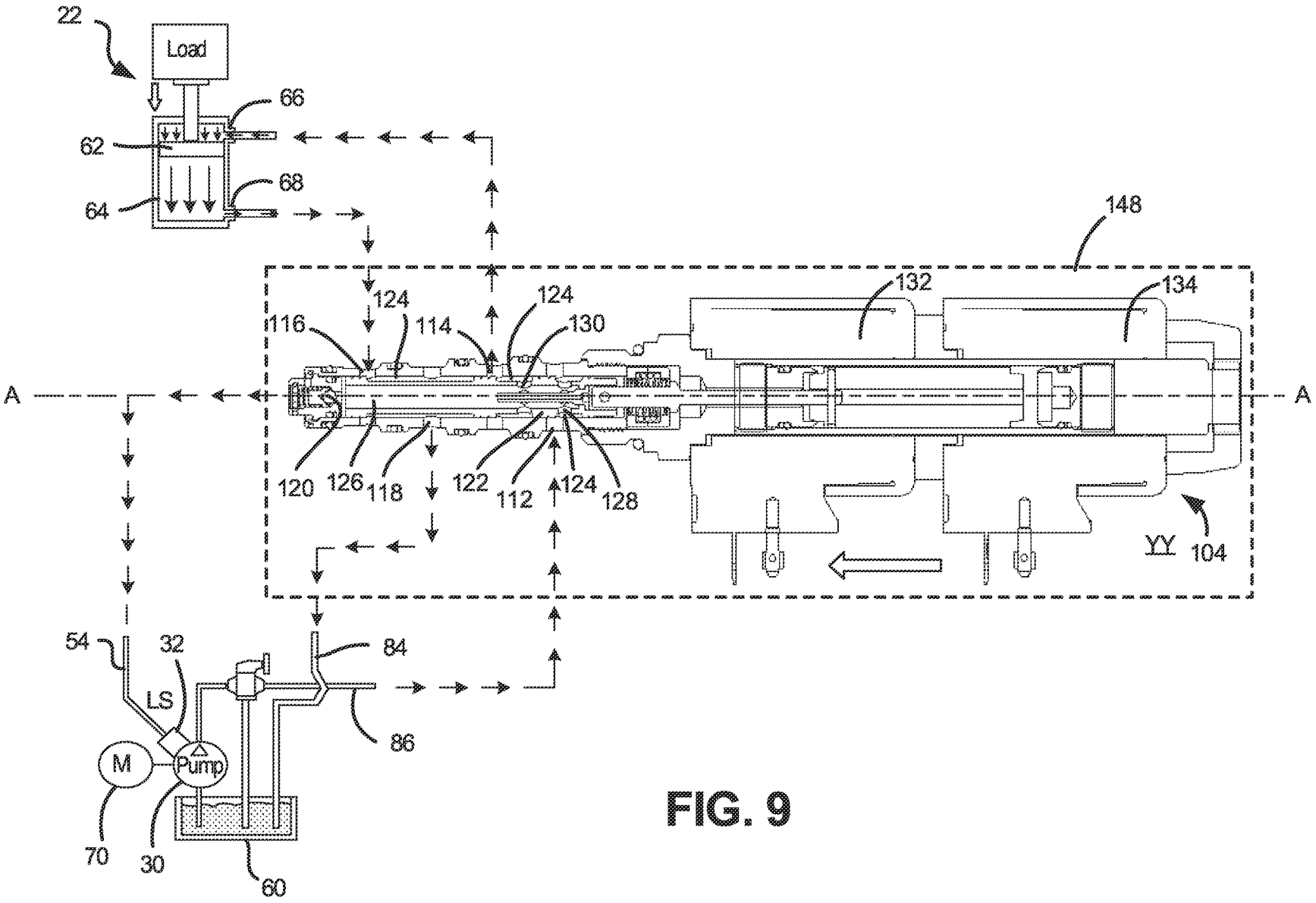
FIG. 9 is a cross-sectional view of the valve of FIG. 8 in a first activated position.

A first proportional solenoid 132 is housed in the manifold block 148, and when activated, moves the spool 110 inside the bore 108 along the major axis A-A from the rested position XX (see FIG. 8) to a first activated position YY (see FIG. 9). A second proportional solenoid 134 is also housed in the manifold block 148, and when activated, moves the spool 110 along the major axis A-A from the rested position XX to a second activated position ZZ (see FIG. 10). The first and second solenoids 132, 134 move the position of the spool 110 proportional to the amount of current supplied to the first and second solenoids 132, 134.

Still referring to FIG. 8, when the spool 110 is in the rested position XX hydraulic fluid from the hydraulic pump 30 is blocked at the pump port 112 by a landing 122 from reaching the first and second work ports 114, 116 and the load sensing port 120.

FIG. 9 is a cross-sectional view of the valve 104 in the first activated position YY. As shown in FIG. 9, when the spool 110 is activated by the first solenoid 132 so that the spool 110 slides along the major axis A-A to the first activated position YY (e.g., to the left in FIG. 8), hydraulic fluid enters a gap between the landing 122 and the pump port 112. The fluid then enters a gallery 124 connected to the first cross hole 128 and flows into the central channel 126 of the spool 110. Next, the hydraulic fluid flows through the second cross hole 130 and enters into a gallery 124 connected to the first work port 114.

The hydraulic fluid then flows into a port 66 and applies a force on a hydraulic piston 62 housed in a cylinder 64 of the actuator 22. In the first activated position YY, hydraulic fluid also flows from the cylinder 64 of the actuator 22 through a port 68 and into the second work port 116. The hydraulic fluid from the actuator 22 then flows into a gallery 124 connected to the tank port 118 for draining to the fluid reservoir 60. In this manner, the hydraulic piston 62 inside the cylinder 64 is displaced in a first direction (e.g., downwards in FIG. 9) by the hydraulic pump 30 powered by the motor 70.

Figure 10:
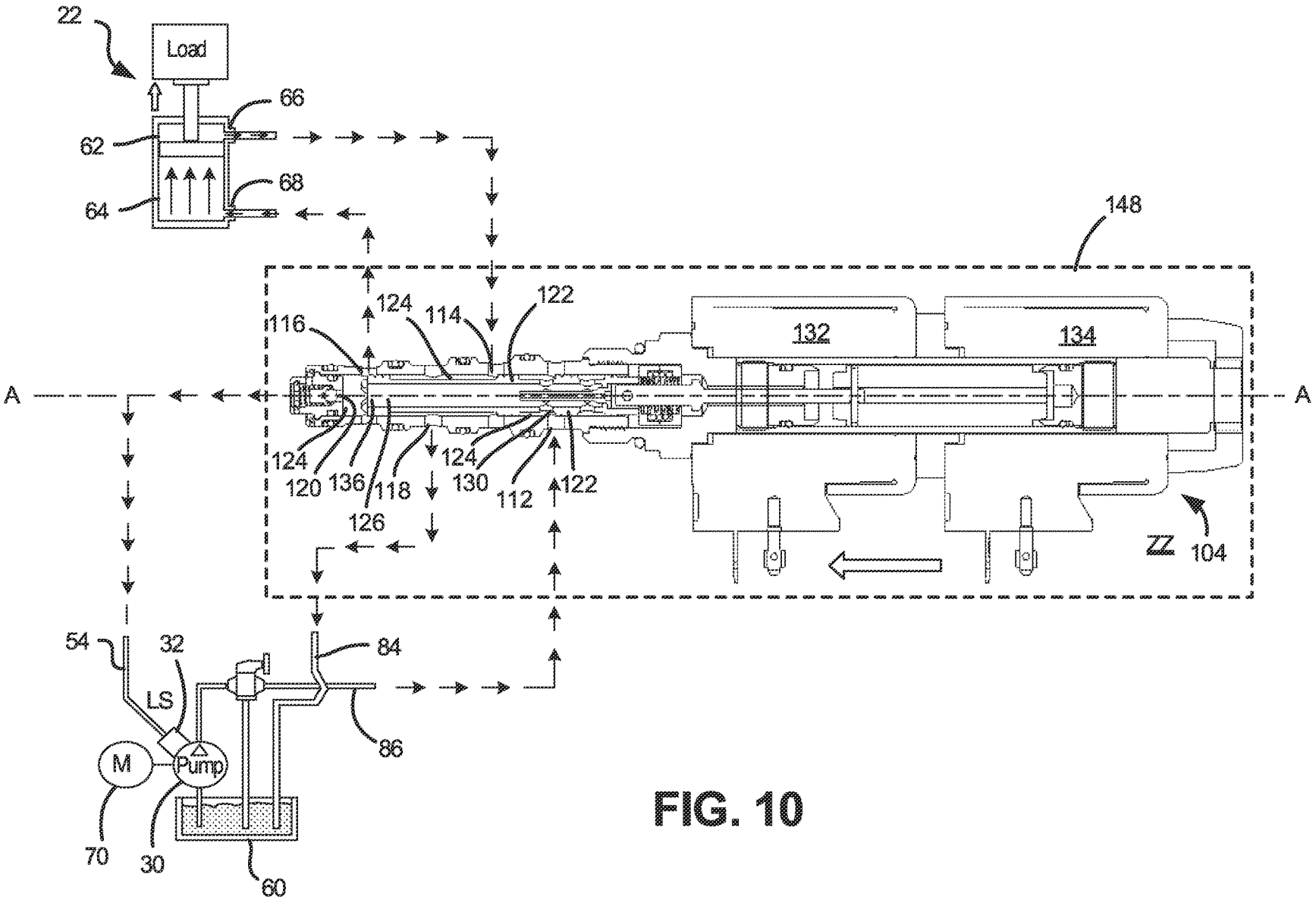
FIG. 10 is a cross-sectional view of the valve of FIG. 8 in a second activated position.

FIG. 10 is a cross-sectional view of the valve 104 in a second activated position ZZ. As shown in FIG. 10, when the spool 110 is activated by the second solenoid 134 so that the spool 110 moves along the major axis A-A to the second activated position ZZ (e.g., to the right in FIG. 8), hydraulic fluid flows from the cylinder 64 through the port 66 and into first work port 114. The fluid from the actuator 22 then flows into a gallery 124 connected to the tank port 118 for draining to the fluid reservoir 60.

In the second activated position ZZ, fluid also enters another gap between the landing 122 and the pump port 112. The hydraulic fluid then enters into a gallery 124 connected to the second cross hole 130 and flows into the central channel 126 of the spool 110. The hydraulic fluid then exits the central channel 126 at an end 136 of the spool 110 and flows into a gallery 124 connected to the second work port 116. The hydraulic fluid then flows into the port 68 and applies a force on the hydraulic piston 62 inside the cylinder 64 such that the hydraulic piston 62 is displaced in a second direction (e.g., upwards) by the hydraulic pump 30. The pressure compensator 32 is mounted directly to the hydraulic pump 30.

In FIGS. 9 and 10, the jet 138 and the push pin of the proportional solenoids 132, 134 are shown not moving with the spool 110, however, in practice the spool 110, jet 138, and the push pin will move together when the proportional solenoids 132, 134 are activated.

Figure 11:
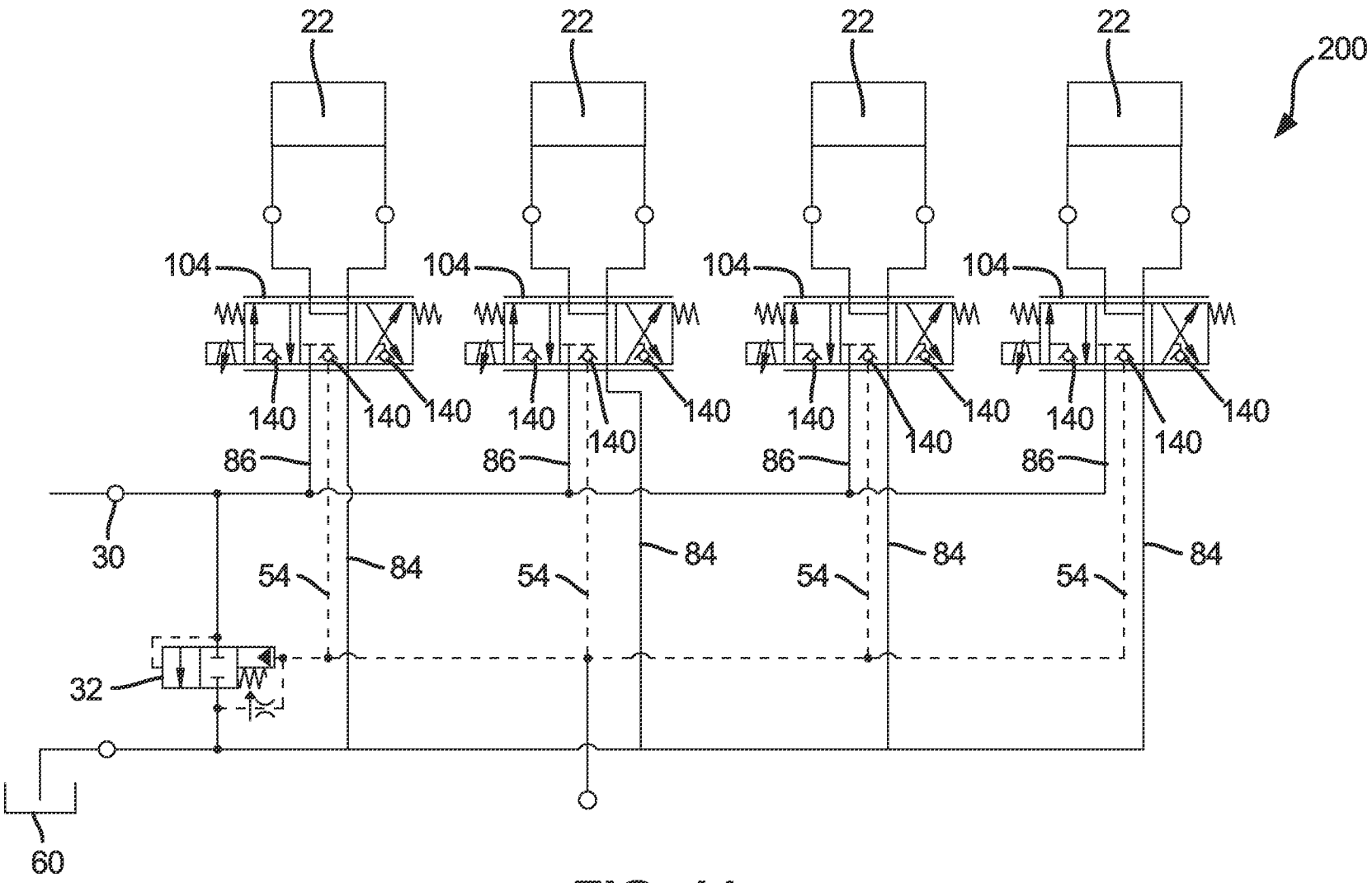
FIG. 11 is a schematic representation of a hydraulic system using the valve of FIG. 8.

FIG. 11 is a schematic representation of a hydraulic system 200 that includes multiple valves 104. As shown in FIG. 11, each valve 104 in the hydraulic system 200 controls the movement of one or more actuators 22 in a mechanical device such as the aerial work platform 10 depicted in FIGS. 1 and 2. Each valve 104 is fed hydraulic fluid from the pump 30 via the pump line 86 connected to the pump port 112 of each valve 104 (see FIGS. 8-10).

Each valve 104 also drains hydraulic fluid from the first and second work ports 114, 116 (see FIGS. 8-10) via the tank line 84 connected to the fluid reservoir 60. Additionally, each valve 104 is connected to the pressure compensator 32 via the load sense line 54. The load sense line 54 receives a load sense pressure from a check valve 140 integrated inside each load sensing port 120 of each valve 104. The load sense line 54 communicates the highest load sense pressure to the pressure compensator 32. The other load sense pressures from the check valves 140 are blocked by the load sense line 54. Each check valve 140 on the load sense line 54 is a non-return type valve that prevents reverse flow of the load sense pressures into the load sensing ports 120. In this manner, only the highest load sense pressure from one of the valves 104 is communicated to the pressure compensator 32.

Figure 12:
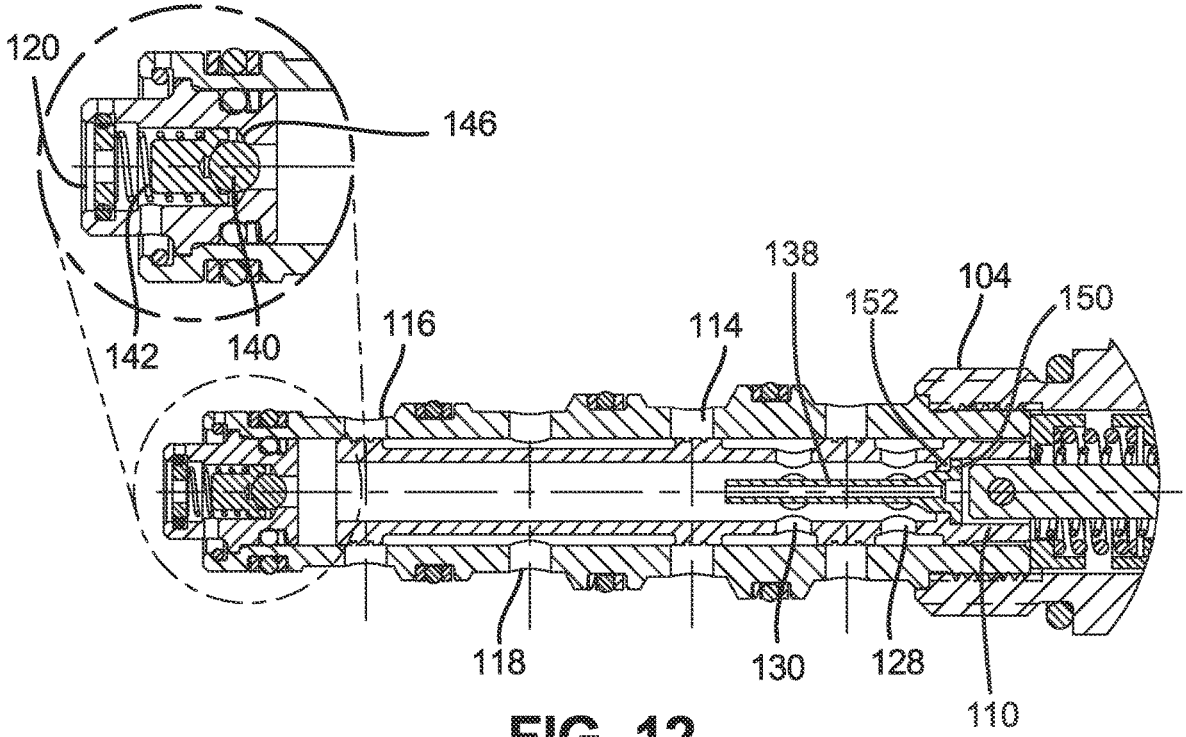
FIG. 12 is a close-up view of the valve of FIG. 8.

FIG. 12 is a close-up cross-sectional view of the valve 104. Referring now to FIG. 12, the check valve 140 inside the load sensing port 120 of the valve 104 has a metering orifice 146 biased in a closed position by a check valve spring 142. The load sensing port 120 receives a load sense pressure when the spool 110 is in the first activated position YY or the second activated position ZZ. When the load sense pressure exceeds a minimum cracking pressure, the check valve spring 142 compresses and the metering orifice 146 begins to open to a metered position. The load sense pressure then travels through the load sensing port 120 into the load sense line 54 connected to the pressure compensator 32. As the load sense pressure increases, the opening of the metering orifice 146 increases.

The metering orifice 146 of the check valve 140 provides a resistance to the flow through the load sense port 120. The resistance from the metering orifice 146 balances the load sense pressure communicated to the load sense line 54 with the actual work port pressure measured at the pump port 112 inside the valve 104. The metering orifice 146 reduces energy consumption in the hydraulic system 200 by preventing the camplate 50 from stroking at a greater displacement angle than needed due to the load sense pressure. Accordingly, the pump 30 operates with improved energy efficiency.

Additionally, by integrating the check valve 140 inside the load sensing port 120 of the valve 104, the size of the valve 104 is reduced. In some examples, the size of the valve 104 is reduced by approximately 21%. Also, the machining and assembly costs for accommodating a check valve in the hydraulic system 200 are reduced because the check valve 140 and metering orifice 146 can be integrated inside the load sensing port 120 without modifying the housing 106 of the valve 104.

Figure 13:
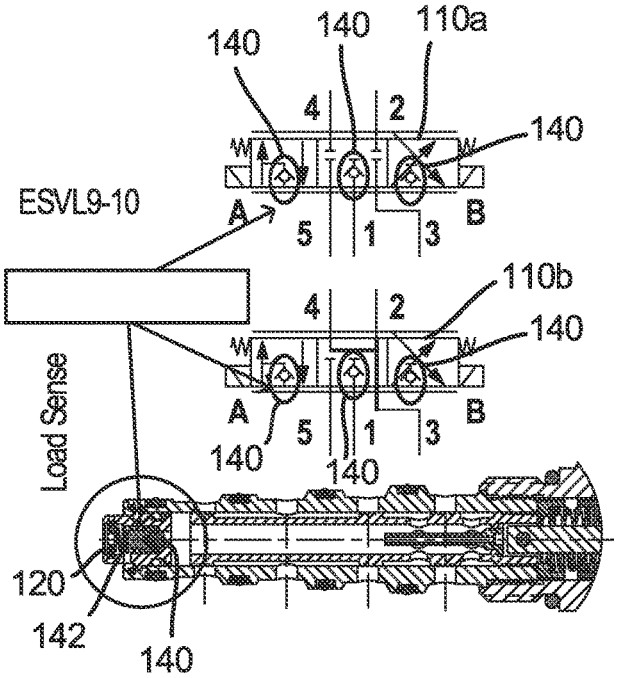
FIG. 13 is a schematic representation of the valve of FIG. 8 having a closed center spool and an open center spool.

FIG. 13 is a schematic representation of the valve 104 having a closed center spool 110*a* and an open center spool 110*b*. As shown in FIG. 13, the integrated check valve 140 and metering orifice 146 may be included in valves having a closed center spool 110*a* or in valves having an open center spool 110*b*. The spools 110*a*, 110*b* can have a standard SiCV housing, and the check valve 140 and metering orifice 146 can be integrated inside the load sensing port 120 of a SiCV housing without modifying or changing the SiCV housing.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. A proportional load sensing hydraulic valve comprising:

a housing having a bore and a major axis that extends through a center of the bore;

a spool inside the bore of the housing and being coaxial with the major axis, the spool being adapted to move along the major axis between a rested position, a first activated position, and a second activated position, wherein the spool includes:

sealing lands for sealing a plurality of galleries between the spool and the bore;

a hollow central channel extending along a length of the spool;

first and second cross holes connecting the central channel to the plurality of galleries; and a jet inside the central channel that communicates pressure between right and left sides of the spool, the jet having a length that extends beyond the second cross hole of the spool by a distance that is approximately 2-3 times the diameter of the second cross hole, and the jet having a flange abutting an inner shoulder of the spool;

a pump port, first and second work ports, a tank port, and a load sensing port, the load sensing port being coaxial with the major axis and the spool, the load sensing port being in fluid communication with the first work port and the pump port when the spool is in the first activated position, and the load sensing port being in fluid communication with the second work port and the pump port when the spool is in the second activated position; and a check valve inside the load sensing port, the check valve having a metering orifice biased in a closed position by a check valve spring;

wherein the metering orifice is adapted to balance a load sense pressure at the pump port with a pressure at each of the first and second work ports; and wherein the check valve is housed inside a body attached to a distal end of the housing at the end of the bore, wherein the body defines the load sensing port and the metering orifice, and wherein the metering orifice is coaxial with the major axis and the spool.

2. The valve of claim 1, wherein the metering orifice opens from the closed position to a metered position when a minimum cracking pressure is reached inside the check valve.

3. The valve of claim 1, wherein fluid communication is blocked between the pump port and the first and second work ports when the spool is in the rested position;

wherein the pump port is in fluid communication with the first work port, and the tank port is in fluid communication with the second work port when the spool is in the first activated position; and wherein the pump port is in fluid communication with the second work port, and the tank port is in fluid communication with the first work port when the spool is in the second activated position.

4. The valve of claim 3, wherein the load sensing port is adapted to communicate the load sense pressure to a pressure compensator when the spool is in the first activated position or the second activated position.

5. The valve of claim 1, wherein the load sensing port is coaxial with the jet.

6. The valve of claim 1, wherein the spool is a closed center spool.

7. The valve of claim 1, wherein the spool is an open center spool.

8. The valve of claim 1, wherein the valve is mounted inside a manifold block.

9. A hydraulic system comprising:

a pump in communication with a fluid reservoir and powered by a motor, the pump including a variable displacement mechanism;

a pressure compensator adapted to adjust the position of the variable displacement mechanism of the pump based on a load sense pressure;

a load sense line adapted to communicate a highest load sense pressure from a plurality of valves to the pressure compensator;

wherein each of the plurality of valves includes:

a spool positioned inside a bore of a housing, the housing defines a pump port, first and second work ports, a tank port, and a load sensing port, the load sensing port includes a check valve having a metering orifice biased in a closed position by a check valve spring, and the check valve is adapted to move from the closed position to a metered position when a minimum cracking pressure is reached, and wherein the spool includes:

sealing lands for sealing a plurality of galleries between the spool and the bore;

a hollow central channel extending along a length of the spool;

first and second cross holes connecting the central channel to the plurality of galleries; and a jet inside the central channel that communicates pressure between right and left sides of the spool, the jet having a length that extends beyond the second cross hole of the spool by a distance that is approximately 2-3 times the diameter of the second cross hole;

wherein the check valve is housed inside a body attached to a distal end of the housing at the end of the bore, wherein the body defines the load sensing port and the metering orifice, and wherein the load sensing port and the metering orifice are coaxial with the major axis and the spool; and wherein the metering orifice is adapted to balance a load sense pressure at the pump port with a pressure at the first and second work ports.

10. The system of claim 9, wherein the pressure compensator adjusts the variable displacement mechanism of the pump based on a highest load sensing pressure for maintaining a constant pressure drop across the first and second work ports in each of the plurality of valves.

11. The system of claim 9, wherein the spool in each of the plurality of valves is a closed center spool.

12. The system of claim 9, wherein the spool in each of the plurality of valves is an open center spool.

13. A proportional load sensing hydraulic valve comprising:

a housing having a bore and a major axis that extends through a center of the bore;

a spool inside the bore of the housing and being coaxial with the major axis, the spool including:

sealing lands for sealing a plurality of galleries between the spool and the bore, a hollow central channel extending along a length of the spool, first and second cross holes connecting the central channel to the plurality of galleries, and a jet inside the central channel that communicates pressure between right and left sides of the spool, the jet having a length that extends beyond the second cross hole of the spool by a distance that is approximately 2-3 times the diameter of the second cross hole, and the jet having a flange abutting an inner shoulder of the spool;

a pump port, first and second work ports, a tank port, and a load sensing port, the load sensing port being coaxial with the major axis and the spool; and a check valve inside the load sensing port, the check valve having a metering orifice biased in a closed position by a check valve spring;

wherein the metering orifice is adapted to balance a load sense pressure at the pump port with a pressure at the first and second work ports.

14. The valve of claim 13, wherein the load sensing port is coaxial with the jet.

15. The valve of claim 13, wherein the metering orifice opens from the closed position to a metered position when a minimum cracking pressure is reached inside the check valve.

* * * * *